US005159769A

United States Patent [19]

Odorisio

[11] Patent Number: 5,159,769

[45] Date of Patent: Nov. 3, 1992

[54] MATERIALS HANDLING DEVICE

[76] Inventor: Nicola Odorisio, 1973 W. Main St., Norristown, Pa. 19403

[21] Appl. No.: 647,292

[22] Filed: Jan. 29, 1991

[51] Int. Cl.[5] ..... E02H 5/02

[52] U.S. Cl. ..... 37/278; 37/284; 37/285; 294/54.5; 294/57

[58] Field of Search ..... 294/54.5, 57; 37/264, 37/265, 272, 278, 284, 285

[56] References Cited

U.S. PATENT DOCUMENTS

| | | | |
|---|---|---|---|
| 157,078 | 11/1874 | Parker et al. | 37/278 X |
| 323,656 | 8/1885 | Franz | 37/278 X |
| 426,435 | 4/1890 | Clark | 37/285 |
| 588,363 | 8/1897 | Stauffer . | |
| 745,608 | 12/1903 | Heermans | 37/278 X |
| 801,090 | 10/1905 | Kenney | 37/277 |
| 992,871 | 5/1911 | Harvey | 37/277 |
| 1,101,149 | 6/1914 | Schoener | 37/278 X |
| 1,561,651 | 11/1925 | Lavell | 37/277 |
| 1,683,732 | 9/1928 | Selin | 37/278 |
| 2,315,743 | 4/1943 | Sieg . | |
| 2,460,560 | 2/1949 | Williams | 37/278 |
| 2,590,143 | 3/1952 | Adams, Jr. et al. | 37/278 X |
| 2,895,237 | 7/1959 | Abrahams | 37/277 |
| 3,136,574 | 6/1964 | Pasquale | 294/54.5 |
| 3,222,699 | 12/1965 | Zeisig | 294/57 X |
| 3,248,811 | 5/1966 | Pravednekow | 37/277 |
| 3,431,661 | 3/1969 | Carlson | 37/277 |
| 4,531,713 | 7/1985 | Balboni | 37/285 X |

*Primary Examiner*—Randolph A. Reese
*Assistant Examiner*—Arlen L. Olsen
*Attorney, Agent, or Firm*—Synnestvedt & Lechner

[57] ABSTRACT

Improved materials handling devices for removing materials from surfaces. The devices described herein efficiently and economically remove materials from a surface with little physical effort. Plows for manually removing materials from a surface comprise a first member having a first concave surface oriented in a first direction, a second concave member connected to the first concave member having a second concave surface oriented in a second direction, the second concave member and first concave member being connected at a single area to form a cutting surface, a bracing member connected to the first and second concave members opposite the cutting surface, and a driving member connected to the bracing member for providing driving power to the plow and force which removes the material from the surface.

7 Claims, 2 Drawing Sheets

MATERIALS HANDLING DEVICE

This invention relates to improved materials handling devices. More particularly, this invention relates to plows for manually removing materials from surfaces.

BACKGROUND OF THE INVENTION

Shovels and scoops are well-known in the art as tools for removing many materials from a path. Shovels and scoops range from large electro-mechanical devices fashioned to remove tons of material from construction sites, to small hand-held manual devices which are used to remove snow from a small path such as a sidewalk. All such scoops and shovels are generally useful for moving materials from one area to another depending on the desires of the individual using the shovel or scoop, the amount of material to be removed, and the time constraints attendant in the particular job to be accomplished.

In the area of small manual devices which are used by individuals to move materials from one spot to another, many shovels and scoops have been devised to accomplish this task. As with most other devices which aid in manual labor, manual shovels and scoops are generally designed with an eye towards making work performed more efficient and less backbreaking for the individual performing with the shovel or scoop. This is particularly true for snow shovels and scoops which are commonly used by individuals in areas which experience substantial snowfall accumulation.

Most individuals who live in these areas must constantly "dig themselves out" from snowfalls so that they may clear their driveways and sidewalks and go about their daily business after a snowfall. However, hardly a snow season passes where reports of individuals who have overexerted themselves and suffered physical injury due to snow shoveling do not reach the media. There is a long-felt need in the art for snow removal and plow devices which efficiently and safely aid individuals in manually removing snow from paths such as, for example, driveways, sidewalks and streets.

Familiarity with standard scoops and shovels for removing snow and other materials will be apparent to those with skill in the art, and methods and apparatus for performing material removal using shovels and scoops are indeed diverse. Generally shovels and scoops comprise a handle for gripping and providing leverage to remove materials of various weights, and a scoop or plow portion fastened to the end of the handle which physically moves material from the surface when force is applied to the handle, thereby scooping the materials or plowing the materials to another area.

In the case of scoop-type materials handling devices, the user must apply force to lift material on the scoop and deftly place the material in another area away from the path which is to be cleaned. In the case of plow-type materials handling devices, the individual exerts pressure on the handle which forces the plow across the surface in an effort to move the material a small distance away from the path which is desired to be cleared.

The aforementioned materials handling devices fail to solve long-felt needs in the art for efficient and easy material removal since both require significant work to be performed in order to accomplish the goal of moving the material away from the path. In the case of the scoop-type shovel, an inordinate amount of labor must be performed to physically move the material in the scoop from one area to another. Depending upon the amount of the material moved, individuals who lack stamina and strength will simply not be able to perform the task of removing the material with a scoop-type shovel materials handling device. In the case of the elderly who live alone but still maintain a residence requiring them to remove snow from the paths around the residence, a scoop-type snow removal shovel presents a significant deterrent from removing the snow since the elderly are not usually able to perform heavy lifting work required with such a manual device. Similarly, individuals with medical problems or who simply lack stamina and strength are unable to remove snow from surfaces with prior shovels and scoops.

Many of the problems apparent in the scoop-type device also exist with plow-type materials handling devices. In addition, plow-type devices are not normally constructed to move materials a far distance from the path, but usually only move the materials a short distance to either side of the path. Therefore if an inordinate amount of material lies on the path to be cleared, a plow-type device simply will not sufficiently move the material away with one pass but must be repeatedly applied to the path in order to clear it. Thus, for individuals who have reduced strength and stamina such as the elderly, a plow-type device is simply ineffective and impractical. Plow-type devices do not satisfy a long-felt need in the art for materials handling devices which efficiently and quickly remove unwanted materials from a path or area to be cleared.

Many shovel and plow materials removal devices have been utilized in the past. For example, U.S. Pat. No. 2,315,743, Sieg, discloses a path-making device which comprises a shovel body and deflector portion connected to a handle. See Sieg, col. 2, lines 27–32. A similar device is disclosed in U.S. Pat. No. 992,871, Harvey, which teaches a combination shovel and plow consisting of a triangular plow frame and plate connected to a handle. See Harvey, col. 1, line 31 through col. 2, line 58.

The devices disclosed in the Sieg and Harvey patents fail to solve a long-felt need in the art for efficient, work-reducing materials handling devices. The problems heretofore delineated with respect to prior materials handling devices are all found in the devices disclosed in Sieg and Harvey and the devices disclosed therein comprise cumbersome metal constructions which are difficult to physically handle. Furthermore, the devices disclosed in the Sieg and Harvey patents are hybrid plows, shovels and scoops which consequently cannot perform efficiently as either a scoop or a plow.

Other scoop-type snow plows are illustrated in U.S. Pat. No. 1,561,651, Lavell. The Lavell patent discloses a scoop-type plow made up of a blade formed from a single piece of sheet metal and shaped into a scraping edge at the forward portion of the plow. The sheet metal plow disclosed in Lavell further comprises an upwardly and rearwardly inclined incising cutting edge which is disposed at a right angle to the scraping edge of the plow. See Lavell, col. 1, lines 26–36. However the construction apparent in the device disclosed in the Lavell patent while purportedly being a scoop, actually more closely resembles a plow-type snow removal device which suffers the infirmity of allowing snow to pile up in the scoop area of the snow plow while being used. The devices disclosed in the Lavell patent cannot efficiently remove snow from a surface since only a small portion of snow can be held in the scoop at any one time, and therefore much physical labor is required to remove large amounts of snow from a single area.

Other shovel-type devices and snow plows are disclosed in U.S. Pat. No. 2,895,237, Abrahams. The device disclosed in the Abrahams patent is a complex metal welded construction which comprises a flat center board with two arcuate wings attached thereto, and a set of plowshares mounted to the center board. Another type of shovel for removing materials is disclosed in U.S. Pat. No. 3,136,574, Pasquale. The Pasquale patent teaches a shovel with a standard blade section, and a handle of U-shaped construction that is attached at an angle to a frame and supporting member which is also U-shaped. The U-shaped construction of the handle and frame members purportedly provides a fulcrum, and two separate locations for gripping by the left and right hands separated by the distance of the handle.

Thus, the device disclosed in the Pasquale patent must be manipulated according to a specific gripping stance which is difficult and cumbersome. Furthermore, the devices disclosed in the Pasquale and Abrahams patents, as well as the other plows and shovels described above do not satisfy a long-felt need in the art for a materials handling device which efficiently and easily removes materials from a desired path or area. This long-felt need has not heretofore been fulfilled by any prior devices.

Several other examples of snow plows and shovels of a similarly heavy metal construction exist in the art. Such devices are disclosed in U.S. Pat. No. 426,435, Clark; U.S. Pat. No. 801,090, Kenney; U.S. Pat. No. 588,363, Stauffer; U.S. Pat. No. 1,683,732, Selin; U.S. Pat. No. 3,248,811, Pravednekow; and U.S. Pat. No. 3,431,661, Karlsen. However, none of the devices disclosed in these patents solve the aforementioned long-felt needs and problems in the art. The advantages and features of materials handling devices provided in accordance with the present invention will be understood from the following detailed description read in conjunction with the drawings.

SUMMARY OF THE INVENTION

Materials handling devices provided in accordance with the present invention solve the aforementioned long-felt needs in the art for efficient and economical removal of materials from surfaces. In preferred embodiments, plows for manually removing materials from a surface comprise a first member having a first concave surface oriented in a first direction, a second concave member connected to the first concave member having a second concave surface oriented in a second direction, the second concave member and first concave member being connected at a single area to form a cutting surface, a bracing member connected to the first and second concave members opposite the cutting surface, and a driving member connected to the bracing member for providing driving power to the plow and force which removes the material from the surface.

Methods provided in accordance with the present invention further solve the aforementioned long-felt needs. Methods of removing material from a surface comprise the steps of displacing an initial amount of material from a surface with a plow comprising a first member having a first concave surface oriented in a first direction, a second concave member connected to the first concave member having a second concave surface oriented in a second direction, the second concave member and first concave member being connected at a single area to form a cutting surface, a bracing member connected to the first and second concave members opposite the cutting surface, a driving member connected to the bracing member for providing driving power to the plow and force which removes the material from the surface, applying continuous resultant force on the plow through the driving member, thereby moving the plow across the surface, and displacing substantially a continuous amount of material from the surface as the plow is moved across the surface, whereby when force is applied to the driving member the plow continuously slides across the surface in the path and substantially removes the material in the path.

DETAILED DESCRIPTION OF PREFERRED EMBODIMENTS

Figure 1:
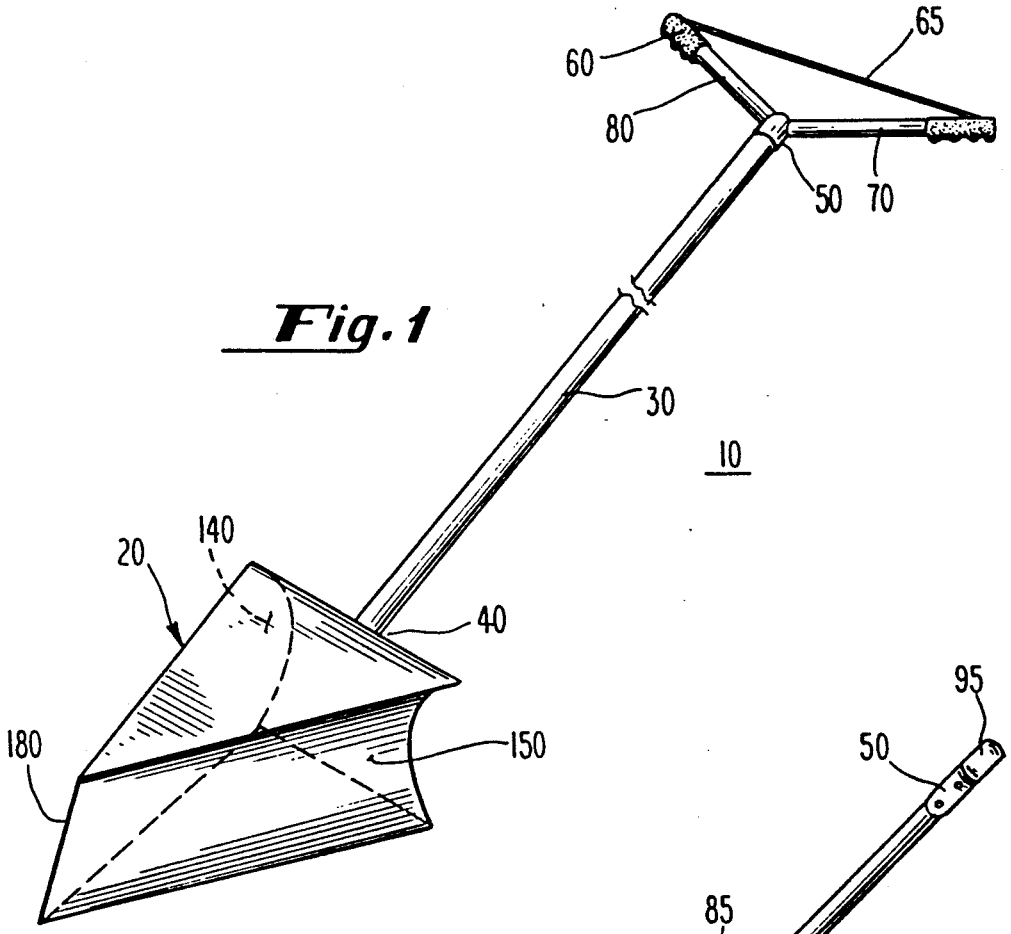
FIG. 1 is an isometric view of a materials handling device provided in accordance with the present invention.

Referring now to the drawings wherein like reference numerals refer to like elements, FIG. 1 shows a materials handling device provided in accordance with the present invention at 10. In preferred embodiments, materials handling device 10 comprises a plow shown generally at 20 adapted to manually remove materials from a surface. The plow 20 is connected to a driving member 30 which preferably comprises a tubular shaft that provides driving power to plow 20 as the plow moves across a surface covered by material which is to be removed. The driving member 30 may be collapsible by insertion of a hinge element in about the middle of the driving member so that the materials handling device 10 can be easily stored in a car trunk or any close area.

The plow 20 is connected to the driving member 30 at a distal end 40 of the driving member. At a proximal end 50 of driving member 30 a handle 60 is provided to the materials handling device. In preferred embodiments handle 60 comprises two lateral shafts 70 and 80, coupled to a proximal end of driving member 30 and extending outward in opposite directions at substantially equal angles, which can be gripped by a user such that the user's hand's are approximately shoulder length apart as he or she applies force down the driving member to the plow. The arrangement of handle means 60 with shafts 70 and 80 gives the user a mechanical advantage to move the materials handling device along the surface so that the plow end 20 can easily and efficiently remove material from the surface along a wide area with one pass of the materials handling device. Alternatively, a user would wedge handle 60 against his or her body and apply force down the driving member by simply walking the materials handling device provided in accordance with the present invention along the path to be cleared. In order to facilitate such action there may be provided to the handle 60 a strap member 65 attahced to the shafts 70 and 80. The strap member 65 preferably loosely swags between the shafts 70 and 80 and comprises a resilient material such as leather or bungy cord. Strap 65 secures against the user's mid-section during use so that force can be uniformly imparted to driving member 30 through handle 60.

In further preferred embodiments, the materials handling device may be constructed out of a lightweight metal. In still further preferred embodiments, the materials handling device may be formed integrally of a lightweight, thermoplastic material, thereby rendering material handling devices provided in accordance with the present invention easily reproducible and economical to manufacture.

Figure 2:
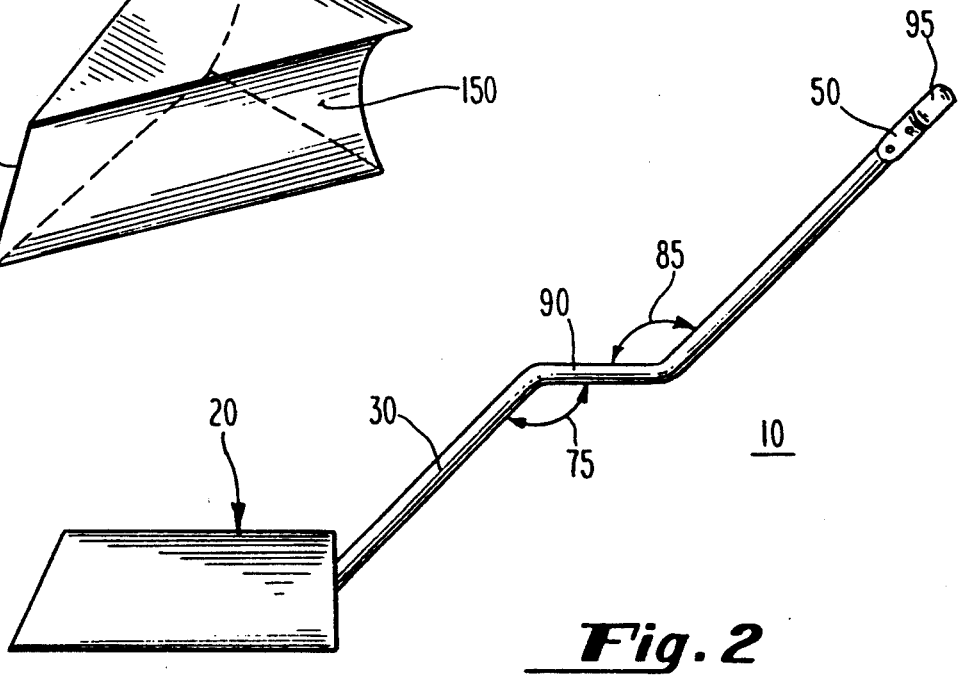
FIG. 2 is a side view of a materials handling device provided in accordance with the present invention.

Referring now to FIG. 2, the plow 20 is substantially a parallelogram in cross-section. In further preferred embodiments, driving member 30 may be bent in at least one location 90 to form preferably two angles in the driving member shown at 75 and 85. In still further preferred embodiments, angles 75 and 85 are bent at substantially 45° angles. By providing the bend 90 to driving member 30, a near maximum resultant force can be applied through handle 50 to plow 20 so that optimal removal of material from the surface can be accomplished. Since bend 90 is provided in accordance with the present invention, the user exerting pressure on driving member 30 achieves substantially a maximum directed driving force down the driving member and imparted to plow 20 so that efficient material removal will occur.

The arrangement achieved by bend 90 is advantageous over other materials removal devices such as snow plows and snow shovels, because these devices generally have a straight shaft that does not direct a resultant force which is focused on the shovel scoop or plow. Therefore, driving member 30 provided in accordance with the present invention having at least one bend 90 with angles 75 and 85 provides a distinct advantage over prior materials removal devices.

In still further preferred embodiments, a standard handle 95 is connected to the driving member 30 at the proximal end 50 of the driving member. As shown in FIG. 2, handle 95 is a single hand grip or loop such that a user may grasp handle 95 with one hand and driving member 30 with another hand to push the plow along the surface. It will be recognized by those with skill in the art that the handle 60 shown in FIG. 1 could be adapted to fit on the proximal end 50 of the driving member 30 shown in FIG. 2 to provide substantially a resultant force to plow 20 in a similar fashion.

Figure 3:
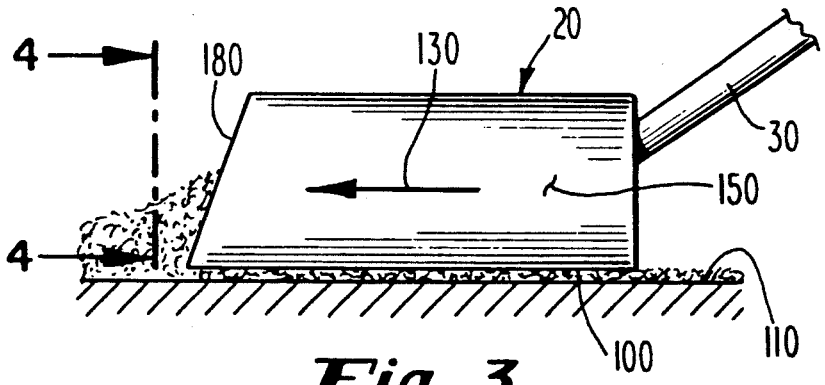
FIG. 3 is a view of a plow member moving along a surface to remove snow.

Referring to FIG. 3, plow 20 is adapted to push materials such as, for example snow, from a surface by sliding across the surface and displacing the material. A substantially flat underside 100 of plow 20 rests on a surface 110 which is covered with, for example, snow 120. Plow 20 is preferably adapted to slide easily across the surface with a minimum amount of driving force, indicated by arrows 130, applied down driving member 30 to plow 20. When the plow is formed of a thermoplastic material, it will easily slide with little friction. However, in preferred embodiments, plow 20 could be coated with, for example, TEFLON, a synthetic resin polymer, or any other permanently lubricating material to allow plow 20 to easily move across the surface. Additionally, the thermoplastic material could also be coated to minimize the frictional forces at the underside 100 and surface 110 interface.

Figure 4:
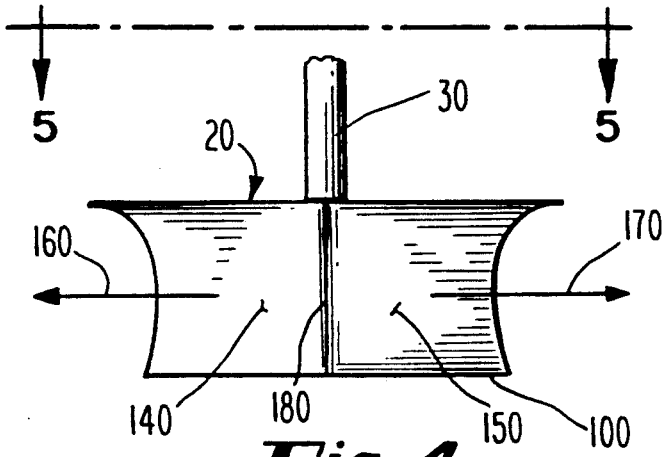
FIG. 4 is a plan view of the plow taken along the 4–4 line of FIG. 3.

In FIG. 4, a plan view of plow 20 taken along the 4–4 line of FIG. 3 is shown. Many of the advantages of the materials handling devices provided in accordance with the present invention result from the construction of two concave plowing members 140 and 150, which are designed to efficiently displace the material as the plow moves across the surface. Plow 20 accomplishes this objective since the first member 140 has a first concave surface oriented in a first preferred direction, shown by arrow 160. Similarly, the second concave member 150 is connected to the first concave member 140 and has a second concave surface oriented in a second preferred direction, indicated by the arrow 170. The first concave member 140 and second concave member 150 are joined together at a single area 180 which acts as a cutting area to cut through the material which must be removed from the surface 110.

In operation of materials handling devices provided in accordance with the present invention, plow 20 moves across surface 110 with sufficient driving force so that material, for example snow, rides up along concave surfaces 140 and 150 and is removed from a path in the direction of the concave surfaces 160 and 170. Material is efficiently removed since the cutting edge formed at area 180 forces material in the path equally on either of the sides of the concave surfaces 140 and 150 which material is then completely removed from the path in a spraying-type action with little effort executed by the user.

Because of the unique design of plow 20 having concave surfaces 140 and 150 positioned to spray the material in the directions 160 and 170, material in the path is efficiently removed from the path with little effort applied. This advantageous result has not heretofore been achieved by prior materials handling devices, for example, snow shovels and snow plows.

Figure 5:
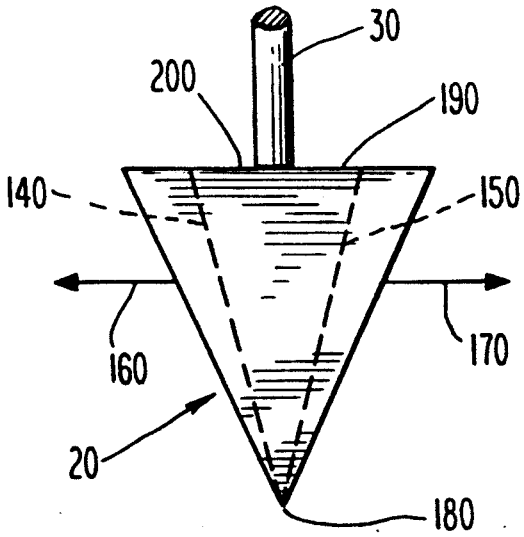
FIG. 5 is a top view of the plow taken along the 5–5 line of FIG. 4.

A top view of plow 20 is illustrated in FIG. 5. Concave surfaces 140 and 150 are shown along with the directions of concavity 160 and 170 that correspond to the directions of the removal of material from a path when plow 20 is applied to the path with a driving force. Area 180 in this top view is represented as a point which connects the first and second concave surfaces 140 and 150 to form the cutting edge of plow 20. Additionally, driving member 30 is fastened to plow 20 at a bracing member 190 which is connected to the first and second concave surfaces opposite point 180 corresponding to the cutting area of the plow.

In the view of FIG. 5 it can be seen that concave members 140 and 150 extend laterally from the distal end of the plow corresponding to vertex point 180, and the bracing means connects the laterally extending concave members opposite the vertex point. This arrangement provides rigidity to plow 20 and allows the driving member to be fastened at the proximal end 200 of the plow 20.

Bracing member 190 is preferably constructed of the same material as plow 20. In still further preferred embodiments, the entire plow and materials handling device comprises a uniform material. This material may be, for example, a thermoplastic material as mentioned above, or a light weight metallic material which provides ease of handling and use. By providing rigidity to the plow 20, bracing means 190 further allows the driving member 30 to uniformly impart maximum resultant force and driving power to plow 20 so that the material can be removed from the surface efficiently, and with a minimal amount of effort exerted by the user.

With materials handling devices provided in accordance with the present invention, an initial amount of material is displaced from the surface with the cutting edge 180 of the plow 20 as previously described. By applying a continuous resultant force down driving member 30 on plow 20, the plowing member moves across the surface to cut a path in the material which is to be removed. Since a continuous amount of material is displaced from the surface as plow 20 moves, substantially all the material can be removed from the path as the material sprays off concave surfaces 140 and 150 in directions 160 and 170 respectively with one fluid movement. This desirous result is accomplished with a minimum of effort by the user and in a very short amount of time. Thus, materials handling devices provided in accordance with the present invention solve a long-felt need for devices which efficiently and quickly remove unwanted materials from surfaces and paths.

There have thus been described certain preferred embodiments of methods and apparatus for handling and removing materials from surfaces. While preferred embodiments have been described and disclosed, it will be recognized by those with skill in the art that modifications are within the true spirit and scope of the invention. The appended claims are intended to cover all such modifications.

I claim:

1. A plow for manually removing material from a surface comprising:

a first member having a first concave surface oriented in a first direction;

a second concave member connected to the first concave member having a second concave surface oriented in a second direction, the second concave member and first concave member being connected at a single area to form a cutting surface;

a bracing member connected to the first and second concave members opposite the cutting surface;

a driving member connected to the bracing member for providing driving power to the plow and force which removes the material from the surface, wherein the driving member comprises a shaft bent at a first angle to facilitate a substantially maximum resultant force on the plow and to provide substantially optimal removal of the material from the surface and wherein the shaft is bent in a second angle to facilitate a substantially maximum resultant force on the plow and to further provide optimal removal of the material from the surface;

a substantially flat plate on an underside having edges connected to lower edges of the first and second concave members and the bracing member lower edge of for resting the plow on the surface and causing the plow to easily slide along the surface when removing material from the surface; and handle means coupled to the driving member for providing gripping power to the plow.

2. The plow recited in claim 1 wherein the first and second angles are substantially forth-five degree angles.

3. The plow recited in claim 2 wherein the plow is integrally constructed of a thermoplastic material.

4. The plow recited in claim 3 wherein the first and second concave member further comprise a TEFLON coating to facilitate sliding of the plow across the surface.

5. The plow recited in claim 4 wherein the handle means comprises a loop gripping member adapted so that one hand of a user can grasp the handle and another hand can grasp the shaft.

6. The plow recited in claim 5 wherein the handle means comprises a pair of outwardly extending members coupled to a proximal end of the shaft and extending in opposite directions at substantially equal angles with respect to the shaft.

7. The plow recited in claim 6 further comprising a strap member connected to the maximal ends of the pair of outwardly extending members, the strap member being adapted to secure against the user as the user applies driving power to the plow.

* * * * *